United States Patent [19]

Zedrosser

[11] Patent Number: 4,555,860

[45] Date of Patent: Dec. 3, 1985

[54] RIFLE BREECH ASSEMBLY

[75] Inventor: Ulrich Zedrosser, Steyr, Austria

[73] Assignee: Steyr-Daimler-Puch Aktiengesellschaft, Vienna, Austria

[21] Appl. No.: 451,042

[22] Filed: Dec. 20, 1982

[30] Foreign Application Priority Data

Mar. 24, 1982 [AT] Austria ..... 1143-82

[51] Int. Cl.[4] ..... F41C 15/00

[52] U.S. Cl. ..... 42/25

[58] Field of Search ..... 42/25

[56] References Cited

U.S. PATENT DOCUMENTS

| | | | |
|---|---|---|---|
| 2,807,902 | 10/1957 | Kopf | 42/25 |
| 3,027,672 | 4/1962 | Sullivan | 42/25 |
| 3,253,362 | 5/1966 | Gitchell | 42/25 |
| 3,848,351 | 11/1974 | Clark | 42/25 |

FOREIGN PATENT DOCUMENTS

| | | |
|---|---|---|
| 277213 | 7/1914 | Fed. Rep. of Germany . |
| 468092 | 6/1914 | France . |
| 2024383A | 1/1980 | United Kingdom . |
| 2060144A | 4/1981 | United Kingdom . |

*Primary Examiner*—Charles T. Jordan
*Assistant Examiner*—Ted L. Parr
*Attorney, Agent, or Firm*—Kurt Kelman

[57] ABSTRACT

A rifle breech assembly comprises a housing adapted to receive the barrel at one end and slidably to receive the breechblock at the other end. The latter carries at its forward end locking bosses, and the housing is formed with grooves which receive the locking bosses and open into an annular recess defined by the rear end of the barrel and permitting a rotation of the breechblock. The breechblock is provided with a resilient pivotally movable extractor disposed between two locking bosses and terminating in an extractor hook. The inside surface of the housing wall constitutes adjacent to the annular recess a surface for radially supporting the extractor hook when the breechblock is locked. A recess which permits a pivotal movement of the extractor is disposed beside that supporting surface in the peripheral direction.

1 Claim, 2 Drawing Figures

RIFLE BREECH ASSEMBLY

Figure 1:
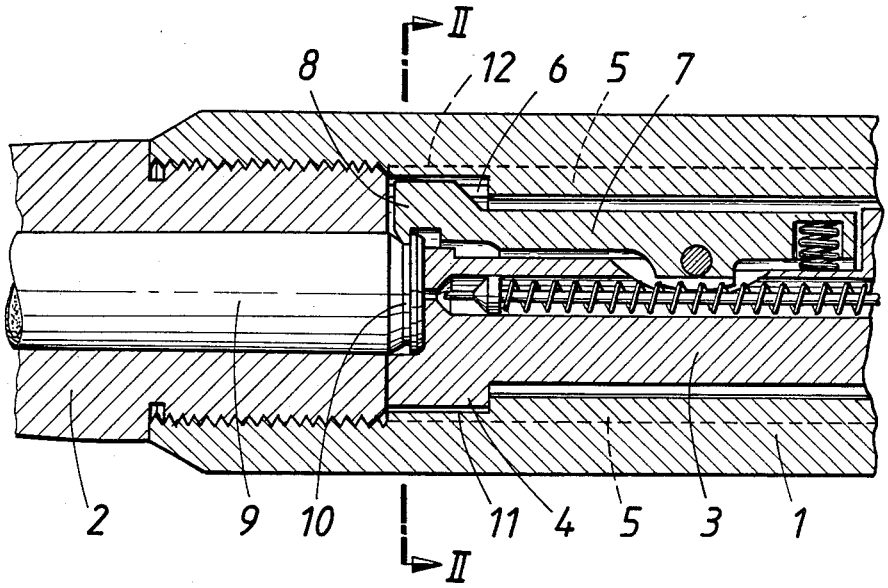

This invention relates to a rifle breech assembly comprising a housing adapted to receive the barrel at one end and slidably to receive the breechblock at the other end. The breechblock carries locking bosses at its forward end, whereas the housing is formed with grooves which receive the locking bosses and open into an annular bore defined by the rear end of the barrel and permitting a rotation of the breechblock. The breechblock is provided with a resiliently pivotal extractor disposed between two locking bosses and terminating in an extractor hook.

Upon the firing of a round, when the barrel of the rifle is clogged by foreign matter, the pressure of the propellant gas will rise greatly above the permissible value so that the cartridge case consisting of brass, as a rule, may be torn. Whereas the cartridge case is embraced by the cartridge chamber of the barrel, the rear end of the cartridge case, which rear end is formed with a groove for receiving the extractor hook, protrudes beyond the rear end of the barrel into the bore formed in the housing. In this bore, the rear end of the cartridge extends into the breechblock as far as to an abutment but that embracing wall of the breechblock is interrupted adjacent to the exterior hook, which is pivotally movable against spring force and cannot withstand the increased gas pressure because that hook is free to move in an annular bore in the known structure. In that known structure, the diameter of the annular bore is such that the extractor can perform in any rotational position of the breechblock the pivotal movement which is required to move over the rear end of the cartridge and cause the hook to snap into the groove in the cartridge. When the cartridge case is torn open adjacent to the extractor hook, the emerging propellant cases will destroy or throw off also adjacent parts of the rifle so that there is a very high risk of an injury of the rifleman. Besides, the rifle is damaged so heavily that it can no longer be used.

It is an object of the invention to eliminate that disadvantage and to provide a rifle breech assembly which is of the kind described first hereinbefore and in which the risk of injury of the rifleman and of a destruction of the rifle is eliminated with simple means.

This object is accomplished according to the invention in that the inside surface of the housing wall at the annular bore constitutes a surface for radially supporting the extractor hook when the breechblock is locked and a recess periodically adjoining the supporting surface to permit a pivotal movement of the extractor.

As the extractor hook is radially supported when the breechblock is locked, the extractor hook can no longer yield and it now constitutes the previously lacking portion of the breechblock embracing the rear end of the cartridge. As a result, a tearing of the cartridge case in the previously endangered region is reliably prevented. Nevertheless, the extractor can fully perform its function because when the breechblock has been rotated out of its locked position the recess formed beside the supporting surface will afford for the extractor a sufficiently large freedom of movement for the required pivotal movement. The manufacturing costs are not increased because it is sufficient to provide a suitably shaped recess.

An illustrative embodiment of the invention is shown on the drawing, in which

Figure 2:
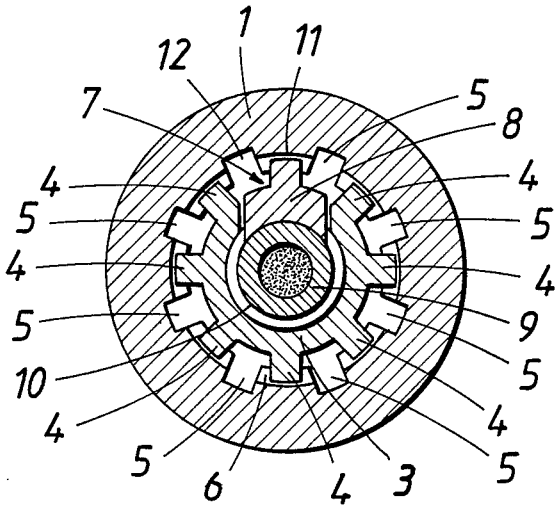

FIG. 1 is an axial sectional view showing the essential components of a rifle breech assembly, and FIG. 2 is a transverse sectional view taken on line II—II in FIG. 1 and shows the assembly with the breechblock locked.

A housing 1 is connected to the stock, not shown, of the rifle. A barrel 2 is screwed into the housing 1 at one end, on the left in FIG. 1. The breechblock 3 is slidably inserted into the housing 1 at the other end and at its forward end is provided with angularly spaced apart locking bosses 4. The housing has angularly spaced apart longitudinal grooves 5 (FIG. 2), which receive said bosses. As the breechblock 3 is inserted into the housing 1, the bosses 4 slide in the grooves 5, which open into an annular bore 6 which can receive the bosses 4 so that the breechblock can be rotated to a locked position when the bosses 4 have been moved throughout the length of the grooves 5 into the annular bore 6. The breechblock 3 is shown in locked position in the drawing.

The breechblock 3 is provided with a springbiased extractor 7, which is pivotally movable in a radial direction. The extractor 7 is disposed between two locking bosses 4 and terminates at its forward end in an extractor hook 8. The cartridge case 9 is disposed in the cartridge chamber of the barrel 2 and protrudes rearwardly to some extent from the rear end of the barrel. The cartridge case 9 is formed near its rear end with an annular groove 10, adapted to receive the extractor hook 8.

At the annular bore 6, the inside peripheral surface of the housing 1 constitutes a surface 11 for radially supporting the extractor hook 8 when the breechblock 3 is locked. It is apparent from FIG. 2 that a radial recess 12 is angularly spaced from the supporting surface 11 and adjoins the latter and permits the pivotal movement of the extractor. For reasons of manufacturing technology, the radial recess 12 has the same shape in cross-section as the longitudinal grooves 5 for receiving the locking bosses 4.

I claim:

1. In a rifle breech assembly comprising a housing having open forward and rear ends and an inside peripheral surface extending from said forward end to said rear end and formed adjacent to said forward end with a forwardly and inwardly open annular bore, said inside peripheral surface defining a plurality of angularly spaced apart grooves which extend along said housing and open into said angular bore, a breechblock extending into said housing from said rear end and provided on the outside at its forward end with locking bosses adapted to enter said grooves and slide therein to guide the bosses into said annular bore, said breechblock being rotatable in said housing when said bosses are disposed in said bore so as to lock said breechblock, said housing being adapted to receive at its forward end a barrel so that the latter constitutes a forward side face of said annular bore, an extractor without a locking boss carried by said breechblock and extending between two of said locking bosses, the extractor having a free end provided with an extractor hook and being pivoted to said breechblock so that said extractor hook is movable radially inwardly and outwardly, and spring means biasing said extractor so as to urge said extractor hook radially inwardly, the improvement comprising that said extractor hook extends into said annular bore and is peripherally movable therein when said locking bosses are disposed in said annular bore, said inside peripheral surface comprises a peripherally and longitudinally extending supporting surface defining said annular bore, said inside peripheral surface defines a radially extending recess radially inwardly open to said annular bore and angularly spaced from and adjoining said supporting surface to receive said extractor hook, and said breechblock with said locking bosses and said extractor hook extending in said annular bore is rotatable in said housing to a locking position in which said supporting surface radially registers with said extractor hook to prevent a radially outwardly directed movement thereof, and to an unlocked position in which said extractor hook radially registers with said radially extending recess and enters the same by a pivotal movement of said extractor and said locking bosses align with said grooves to permit sliding of said breechblock in said housing.

* * * * *